US007841140B1

(12) United States Patent
Sorkin

(10) Patent No.: US 7,841,140 B1
(45) Date of Patent: Nov. 30, 2010

(54) APPARATUS FOR PREVENTING SHRINKAGE OF A SHEATHING OVER A TENDON

(76) Inventor: Felix L. Sorkin, 13022 Trinity Dr., Stafford, TX (US) 77477

( * ) Notice: Subject to any disclaimer, the term of this patent is extended or adjusted under 35 U.S.C. 154(b) by 419 days.

(21) Appl. No.: 11/861,185

(22) Filed: Sep. 25, 2007

(51) Int. Cl.
*E04C 5/08* (2006.01)

(52) U.S. Cl. ..... 52/223.13; 403/314; 403/367; 403/369; 403/374.1

(58) Field of Classification Search ..... 52/223.13; 403/304, 314, 367, 368, 369, 365, 374.1; 24/122.6, 122.3, 459, 136 R, 115 M
See application file for complete search history.

(56) References Cited

U.S. PATENT DOCUMENTS

| | | | | | |
|---|---|---|---|---|---|
| 274,796 | A | * | 3/1883 | Loehner | 403/314 |
| 833,548 | A | * | 10/1906 | Putnam | 403/368 |
| 1,646,660 | A | * | 10/1927 | Prince | 439/805 |
| 2,166,458 | A | * | 7/1939 | Berndt et al. | 439/788 |
| 3,534,989 | A | * | 10/1970 | Yonkers | 403/369 |
| 3,596,330 | A | * | 8/1971 | Scott et al. | 24/122.3 |
| 3,698,749 | A | * | 10/1972 | Yonkers | 403/197 |
| 4,494,890 | A | * | 1/1985 | Lusk | 403/267 |
| 4,619,088 | A | * | 10/1986 | Ripoll Garcia-Mansilla | 52/223.13 |
| 5,469,677 | A | * | 11/1995 | Luthi | 52/223.13 |
| 5,630,301 | A | * | 5/1997 | Sieg | 52/223.13 |
| 5,770,286 | A | | 6/1998 | Sorkin | |
| 5,839,235 | A | | 11/1998 | Sorkin | |
| 5,897,102 | A | * | 4/1999 | Sorkin | 254/29 A |
| 6,098,356 | A | | 8/2000 | Sorkin | |
| 6,381,912 | B1 | | 5/2002 | Sorkin | |
| 6,513,287 | B1 | | 2/2003 | Sorkin | |
| 6,631,596 | B1 | | 10/2003 | Sorkin | |
| 6,817,148 | B1 | | 11/2004 | Sorkin | |

* cited by examiner

*Primary Examiner*—Brian E Glessner
(74) *Attorney, Agent, or Firm*—Egbert Law Offices PLLC

(57) ABSTRACT

An apparatus for fixing the sheathing of an end of a tendon within an anchor body of a post-tension anchor system has an anchor body with a cavity formed therein, a tendon extending into the cavity, a fixing element engaged with the sheathing of the tendon for fixing a position of the sheathing on the tendon, and a pair of wedges in engagement with the unsheathed portion of tendon within the anchor body. The fixing element is positioned within the cavity. The fixing element can either be a wedge member interposed between the sheathing and the tendon so as to frictionally engage the tendon or a clip member engaged with the sheathing.

8 Claims, 3 Drawing Sheets

APPARATUS FOR PREVENTING SHRINKAGE OF A SHEATHING OVER A TENDON

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to post tension anchor systems. More particularly, the present invention relates to dead-end anchors used in such post-tension systems. More particularly, the present invention relates to devices and methods used to prevent shrinkage of a sheathing that extends over the tendon.

2. Description of Related Art Including Information Disclosed Under 37 CFR 1.97 and 37 CFR 1.98

For many years, the design of concrete structures imitated the typical steel design of column, girder and beam. With technological advances in structural concrete, however, concrete design began to evolve. Concrete has the advantages of costing less than steel, of not requiring fireproofing, and of having plasticity, a quality that lends itself to free flowing or boldly massive architectural concepts. On the other hand, structural concrete, though quite capable of carrying almost any compressive load, is weak in carrying significant tensile loads. It becomes necessary, therefore, to add steel bars, called reinforcements, to concrete, thus allowing the concrete to carry the compressive forces and the steel to carry the tensile forces.

Structures of reinforced concrete maybe constructed with load-bearing walls, but this method does not use the full potentialities of the concrete. The skeleton frame, in which the floors and roofs rest directly on exterior and interior reinforced-concrete columns, has proven to be most economical and popular. Reinforced-concrete framing is seemingly a simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the form work. The size and number of the steel bars depends completely upon the imposed loads and the need to transfer these loads evenly throughout the building and down to the foundation. After the reinforcing is set in place, the concrete, comprising a mixture of water, cement, sand, and stone or aggregate and having proportions calculated to produce the required strength, is set, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as five hundred feet can be attained in members as deep as three feet for roof loads. The basic principle is simple. In pre-stressing, reinforcing tendons of high tensile strength wires are stretched to a certain determined limit and then high-strength concrete is placed around them. When the concrete has set, it holds the steel in a tight grip, preventing slippage or sagging. Post-tensioning follows the same principle, but the reinforcing tendon, usually a steel cable, is held loosely in place while the concrete is placed around it. The reinforcing tendon is then stretched by hydraulic jacks and securely anchored into place. Pre-stressing is done with individual members in the shop and post-tensioning as part of the structure on the site.

In a typical tendon tensioning anchor assembly used in such post-tensioning operations, there are provided anchors for anchoring the ends of the cables suspended therebetween. In the course of tensioning the cable in a concrete structure, a hydraulic jack or the like is releasably attached to one of the exposed ends of each cable for applying a predetermined amount of tension to the tendon, which extends through the anchor. When the desired amount of tension is applied to the cable, wedges, threaded nuts, or the like, are used to capture the cable at the anchor plate and, as the jack is removed from the tendon, to prevent its relaxation and hold it in its stressed condition.

In typical post-tension systems, the tendon is received between a pair of anchors. One of the anchors is known as the "live-end" anchor, and the opposite end is known as the "dead-end" anchor. The "live-end" anchor receives the end of the tendon which is to be tensioned. The "dead-end" anchor holds the tendon in place during the tensioning operation. Under typical operations, a plurality of wedges are inserted into an interior passageway of the anchor and around the exterior surface of the tendon. The tendon is then tensioned so as to draw the wedges inwardly into the interior passageway so as establish compressive and locking contact with an exterior surface of the tendon. This dead-end anchor can then be shipped, along with the tendon, for use at the job site.

One technique for forming such dead-end anchors is to insert the end of a tendon into the cavity of the anchor, inserting wedges into the space between the tendon and the wall of the cavity and then applying a tension force onto another end of the tendon so as to draw the wedges and the end of the tendon into the cavity in interference-fit relationship therewith. This procedure is somewhat difficult since the tendon can have a considerable length and since the use of tension forces can create a somewhat unreliable connection between the wedges and the tendon. Experimentation has found that the application of compressive force onto the end of the tendon creates a better interference-fit relationship between the wedges, the end of the tendon and the wall of the cavity of the anchor.

Another technique is described in U.S. Pat. No. 6,513,287, issued on Feb. 4, 2003 to the present inventor. This patent describes a method and apparatus for forming an anchorage of a post-tension system in which a tendon is positioned within a cavity of the anchor such that an end of the tendon extends outwardly of the cavity. A plurality of wedges are mechanically inserted within the cavity between the tendon and a wall of the cavity. Pressure is applied to an end of the tendon such that the tendon and the wedges are in interference-fit relationship within the cavity. A compression mechanism has a cylindrical member and a plunger extending in a channel of the cylindrical member. The wedges are attached to the cylindrical member and the cylindrical member is moved toward the cavity such that the wedges enter a space between the tendon and the wall of the cavity. The plunger applies a compressive force to the end of the tendon when the end of the tendon is in the channel of the cylindrical member.

One of the problems with conventional dead-end anchorages is that the sheathing over the tendon has a tendency to shrink over time. The shrinkage is the result of various factors. One major factor is that the sheathing is formed over the tendon in an extrusion process. As such, the polymeric material used for the sheathing is relatively hot as it exits the extrusion process. Immediately after leaving the extrusion process, the tendon, along with the sheathing, are tightly wound around a spool. During shipment, the tight winding of the tendon around the spool will mechanically resist any shrinking of the sheathing over the lubricated exterior of the steel cable on the interior of the tendon. When the cable is unwound from the spool, these mechanical forces are released. As such, as the tendon is installed in an anchor, the relaxation of these mechanical forces will generally and slowly cause the sheathing to shrink over the length of the tendon. After the tendon is connected to a dead end anchorage, the end of the sheathing will tend to the shrink slowly away from the dead end anchorage.

The problem that affects many anchorage system is the inability to effectively prevent liquid intrusion into this area of the unsheathed portion. In normal practice, a liquid-tight tubular member is placed onto an end of the tendon so as to cover an unsheathed portion of the tendon. The tubular member slides onto and over the trumpet portion of the encapsulated anchor so as to be frictionally engaged with the trumpet portion of the anchor. The opposite end of the tubular member will include a seal that establishes a generally liquid-tight connection with the sheathed portion of the tendon.

In the past, various patents have issued to the present inventor relating to such corrosion-protection tubes. These patents were developed for the purpose of accommodating the natural shrinkage of the sheathing over the lubricated cable. For example, U.S. Pat. No. 5,839,235, issued on Nov. 20, 1998 to the present inventor, describes a corrosion protection tube for a post-tension anchor system. A tubular body is affixed in snap-fit engagement with the trumpet portion so as to extend outwardly from the trumpet portion in axial alignment therewith. The tubular body has a seal at an end opposite the trumpet portion so as to form a generally liquid-tight seal with an exterior surface of the tendon. The tubular body has a notch formed on an exterior surface thereof. The trumpet portion has an inwardly extending surface. The inwardly extending surface engages the notch so as to form a generally liquid-tight connection. A collar extends around the tubular body on a side of the notch so as to be in close relationship to the end of the trumpet portion.

U.S. Pat. No. 6,631,596, issued on Oct. 14, 2003 to the present inventor, teaches another corrosion protection tube for use on an anchor of a post-tension anchor system. This corrosion protection tube has a connection portion at one end and a sealing portion on an opposite end. The anchor has a trumpet portion with a notch extending therearound. The connection portion includes an inwardly extending surface for engagement with the notch of the trumpet portion. The sealing portion is in liquid-tight engagement with the sheathed portion of the tendon. Alternatively, the connection portion includes an additional inner sleeve so as to define an annular slot with the inwardly extending surface. The inner sleeve extends into the interior of the trumpet portion so that the inner sleeve and the trumpet portion are in a liquid-tight engagement.

U.S. Pat. No. 6,817,148, issued on Nov. 16, 2004 to the present inventor, describes another type of corrosion protection seal for the anchor of a post-tension anchor system. A seal member is affixed to an end of the tubular portion of the anchor opposite the anchor body. The seal member has a portion extending around the sheathed portion of the tendon in generally liquid-tight relationship therewith. The tubular portion has an interlock area extending therearound for engaging an interior surface of the seal member. The tubular portion has a length of generally greater than four inches extending outwardly of the anchor body.

U.S. Pat. No. 5,770,286, issued on Jun. 23, 1998 to the present inventor, shows a corrosion inhibitor retaining seal. This seal includes a cap having a tubular body and a surface extending across the of the tubular body. A corrosion-resistant material is contained within the interior area of the cap. This surface closes the end of the tubular body. A frangible area is formed on this surface The surface extends transverse to a longitudinal axis of the tubular body at one end of the tubular body. The frangible area has a thickness less than a thickness of a non-frangible remainder of the surface. The cap is formed of a polymeric material. The surface is formed of a deformable polymeric material such that the non-frangible portion of the surface forms a liquid-tight seal with an outer diameter of a tendon extending through the surface. The corrosion-resistant material is contained within the cap of a suitable volume so as to fill a void in the tubular member between the inner diameter of the tubular member and the outer diameter of a tendon extending therethrough.

U.S. Pat. No. 6,098,356, issued on Aug. 8, 2000 to the present inventor, shows a method and apparatus for sealing an intermediate anchorage of a post-tension system. This apparatus has a cap with an attachment section thereon. The attachment section is adapted to allow the cap to be connected to an end of the anchor body. The cap has a tubular member extending outwardly from the attachment section. The tubular member has an opening at an end opposite the attachment section. The cap also has a grease fitting formed thereon. The grease fitting is adapted so as to allow grease to be introduced into the interior passageway of the tubular member. The attachment section and the tubular member are integrally formed together of a polymeric material. A seal is affixed to the open end of the tubular member so as to form a liquid-tight seal over the sheathed portion of a tendon extending therethrough.

U.S. Pat. No. 6,381,912, issued on May 7, 2002 to the present inventor also shows a method of sealing the intermediate anchor of a post-tension system. An elastomeric seal has one end affixed to the anchor member and extending outwardly therefrom. A rigid ring member is detachably received within an opposite end of the seal. The ring member has an inner diameter greater than an outer diameter of the tendon.

The opposite end of the seal is in liquid-tight compressive contact with the exterior surface of the tendon when the ring member is detached from the seal. The interior passageway of the anchor, the seal and the ring member have an inner diameter, when joined together, which is larger than the outer diameter of the tendon so as to allow the anchor member, the seal and the ring member to slide along the length of the tendon.

As can be seen, there is a great deal of technology associated with this need to accommodate the shrinkage of the sheathing over the cable of the tendon of the post-tension anchor system. Each of this technology suggests the placement of an additional tube over the polymeric encapsulation and additional materials for sealing the unsheathed portion of the tendon which extends outwardly of the anchor. In certain circumstances, these tubes are sometimes improperly installed and, at best, are simply an additional component that needs to be associated with the post-tension system. As such, it adds additional costs and can require additional labor associated with the installation of the sealing tube. As such, a need has developed so as to avoid the use of such a tube with the dead-end anchor of a post-tension anchor system.

It is an object of the present invention to provide an apparatus which effectively prevents shrinkage of the sheathing at the dead-end anchor of a post-tension anchor system.

It is another object of the present invention to provide an apparatus that can be easily installed during the installation of the wedges associated with the dead-end anchorage of a post-tension anchor system.

It is a further object of the present invention to provide an apparatus which effectively engages the sheathing at the dead-end anchorage so as to resist shrinkage forces associated with the sheathing.

It is still another object of the present invention to provide an apparatus which resists the shrinkage of the sheathing of a tendon of a post-tension anchor system which is easy to install, relatively inexpensive and easy to manufacture.

These and other objects and advantages of the present invention will become apparent from a reading of the attached specification and appended claims.

BRIEF SUMMARY OF THE INVENTION

The present invention is an apparatus for preventing the shrinkage of a sheathing at the dead-end anchorage of a post-tension anchor system. This apparatus includes an anchor body having a cavity formed in an interior thereof, a tendon extending into the cavity, a fixing means engaged with the sheathing of the tendon for fixing a position of the sheathing on the tendon, and a pair of wedges in frictional engagement with the unsheathed portion of tendon in the cavity of the anchor body. The tendon has a sheathing extending at least partially thereover. The tendon has a sheathed portion and an unsheathed portion.

The sheathed portion extends into the cavity of the anchor body. The fixing means is positioned in this cavity. In the preferred embodiment of the present invention, the fixing means includes at least one wedge member interposed between the sheathing and the tendon so as to engage the sheathing. The sheathing is in frictional contact with a wall of the cavity and a surface of the wedge member. In particular, this fixing means includes a pair of wedge members interposed between the tendon and the sheathing so as to engage the sheathing between the outer surface of the pair of wedge members and a wall of the cavity. The pair of wedge members are positioned adjacent to an end of the pair of wedges within the cavity.

The anchor body has a polymeric encapsulation extending thereover. This polymeric encapsulation defines a trumpet extending outwardly of the anchor body in axial alignment with the cavity. The sheathed portion of the tendon extends through this trumpet. The cavity of the anchor body has a tapered portion so as to have wide end opening at one end of the anchor body and a narrow end interior of the anchor body. The cavity has a passageway extending from the narrow end so as to open at an opposite end of the anchor body. The fixing means is positioned in the passageway. The pair of wedges extends along the tapered portion of the cavity. The fixing means is adjacent the end of the pair of wedges within the cavity. The passageway has a generally constant diameter. The fixing means retains an end of the sheathed portion within this passageway. The trumpet has a seal extending around an interior thereof so as to be in liquid-tight sealing relationship with the sheathed portion of the tendon.

In an alternative form of the present invention, the fixing means includes a clip member engaged with the sheathing in the cavity. This pair of clip members is arranged on diametrically opposite sides of the sheathing. The pair of clip members has an edge biting into the sheathing. The pair of clip members are interposed between a wall of the cavity and the sheathing. This pair of clip members is positioned adjacent an end of the pair of wedges within the cavity.

DETAILED DESCRIPTION OF THE INVENTION

Figure 1:
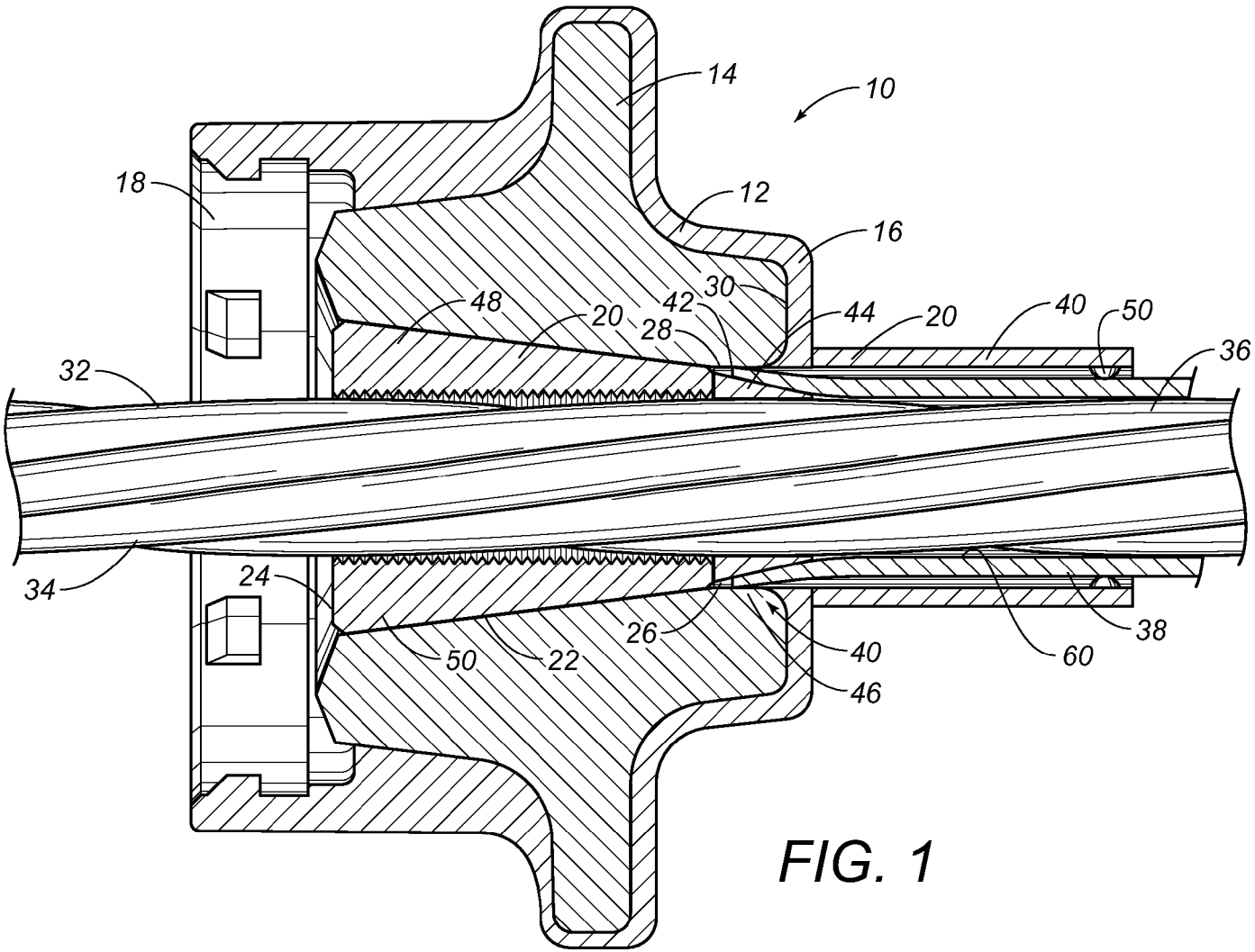
FIG. 1 is a cross-sectional view of the apparatus of the present invention.

Referring to FIG. 1, there is shown the apparatus 10 for the resisting of the shrinkage of a sheathing of a tendon in a post-tension anchor system. In particular, the apparatus 10 shows the dead-end anchorage 12. The dead-end anchorage 12 includes an anchor body 14 with a polymeric encapsulation 16 extending thereover and therearound. A cap-receiving opening 18 is formed at one end of the polymeric encapsulation 16. A trumpet 20 is formed at the opposite end of the polymeric encapsulation 16. The trumpet 20 is a tubular section that extends outwardly of the end of the dead-end anchorage 12 for a short distance. The anchor body 14 is a steel anchor. The anchor body 14 has a cavity 22 formed in an interior thereof. The cavity 22 has tapered walls having a wide end 24 and a narrow end 26. The wide end 24 opens at an end of the anchor body 14. The narrow end 26 opens on the interior of the cavity 22. A passageway 28 extends from the narrow end 26 of cavity 22 to the opposite end 30 of the anchor body 14.

A tendon 32 extends entirely through the cavity 22 of the anchor body 14. The tendon 32 also extends through the trumpet 20 of the polymeric encapsulation 16. The tendon 32 has an unsheathed portion 34 and a sheathed portion 36. Sheathing 38 extends over the tendon 32. Typically, a lubricant will be applied between the exterior surface of the tendon 32 and the inner surface 60 of the sheathing 38.

In the present invention, a fixing means 40 is positioned in the passageway 28 of cavity 22. The fixing means 40 serves to engage with the end 42 of the sheathing 38 so as to strongly adhere the end 42 of the sheathing 38 within the passageway 28.

As can be seen in FIG. 1, the fixing means 40 includes a pair of wedge members 44 and 46 that will be interposed between the end 42 of the sheathing 38 and the surface of the tendon 32. Each of wedge members 44 and 46 generally abuts the ends of the wedges 48 and 50, respectively, extending within the cavity 22. Each of the wedge members 44 and 46 exerts a force on the end 42 of the sheathing 38 which causes the end 42 of the sheathing 38 to be rigidly retained in frictional relationship between inner wall of the passageway 28 and the outer surface of the wedge members 44 and 46. As such, the end 42 of the sheathing 38 is fixedly retained within the passageway 28. Because of this fixed retention, any shrinkage effects are avoided at the dead-end anchorage 12 of apparatus 10.

This frictional engagement is extremely effective in preventing the shrinkage of the sheathing 38. Typically, the force of shrinkage is between 100 and 150 pounds of pulling force. On the other hand, the force of the wedges 48 and 50, as installed, will resist 30,000 pounds of force applied to the tendon 32. As such, although the engagement of the end 42 of sheathing 38 with the wall the passageway 28 would appear to be rather weak, the forces are actually very strong as compared to those that are required in order to keep the sheathing 38 from shrinking.

The trumpet 20 includes an annular seal 50 extending around an interior thereof. The annular seal 50 will be in liquid-tight engagement with a surface of the sheathing 38. As such, the seal 50 effectively prevents liquid intrusion into the interior cavity 22 of the anchor body 14. The present invention, in this manner, effectively avoids the use of any sealing tubes that are affixed over, under or around the trumpet 20 of the encapsulation 16.

Figure 2:
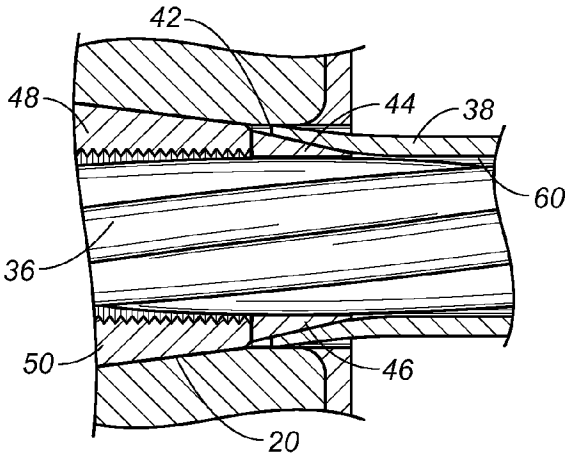
FIG. 2 is an enlarged cross-sectional view showing the relationship of the wedge members and the sheathing of the tendon.

FIG. 2 shows, in detail, how the wedge members 44 and 46 are inserted between the inner surface 60 the sheathing 38 and the outer surface of the tendon 32. Wedge members 44 and 46 will be urged into the space by the action of the wedges 48 and 50 during installation. Each of the wedge members 44 and 46 exerts a strong force against the inner wall 60 of the sheathing 38 so as to friction-fit the end 42 of the sheathing 38 against the inner wall of passageway 28 of cavity 22.

Figure 3:
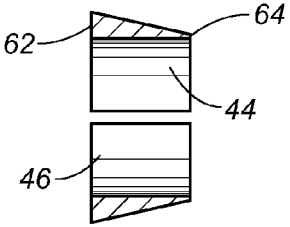
FIG. 3 is an isolated, cross sectional view of the wedge members for engaging the end of the sheathing.

FIG. 3 shows a cross-sectional view of the wedge members 44 and 46. As can be seen, the wedge members 44 and 46 have a wide end 62 and a narrow end 64. Each of the wedge members 44 and 46 will extend generally around the diameter of the tendon 32 so as to form a continuous retaining relationship between the exterior of each of the wedge members 44 and 46 and the inner surface 60 of the sheathing 38. Additionally, because of this encircling relationship between the wedge members 44 and 46 and the strong friction-fit relationship between the end 42 of the sheathing 38 and the inner wall of the passageway 28, liquid intrusion into the cavity is effectively prevented. This relationship serves as a further "secondary" seal so as to prevent liquid intrusion.

Figure 4:
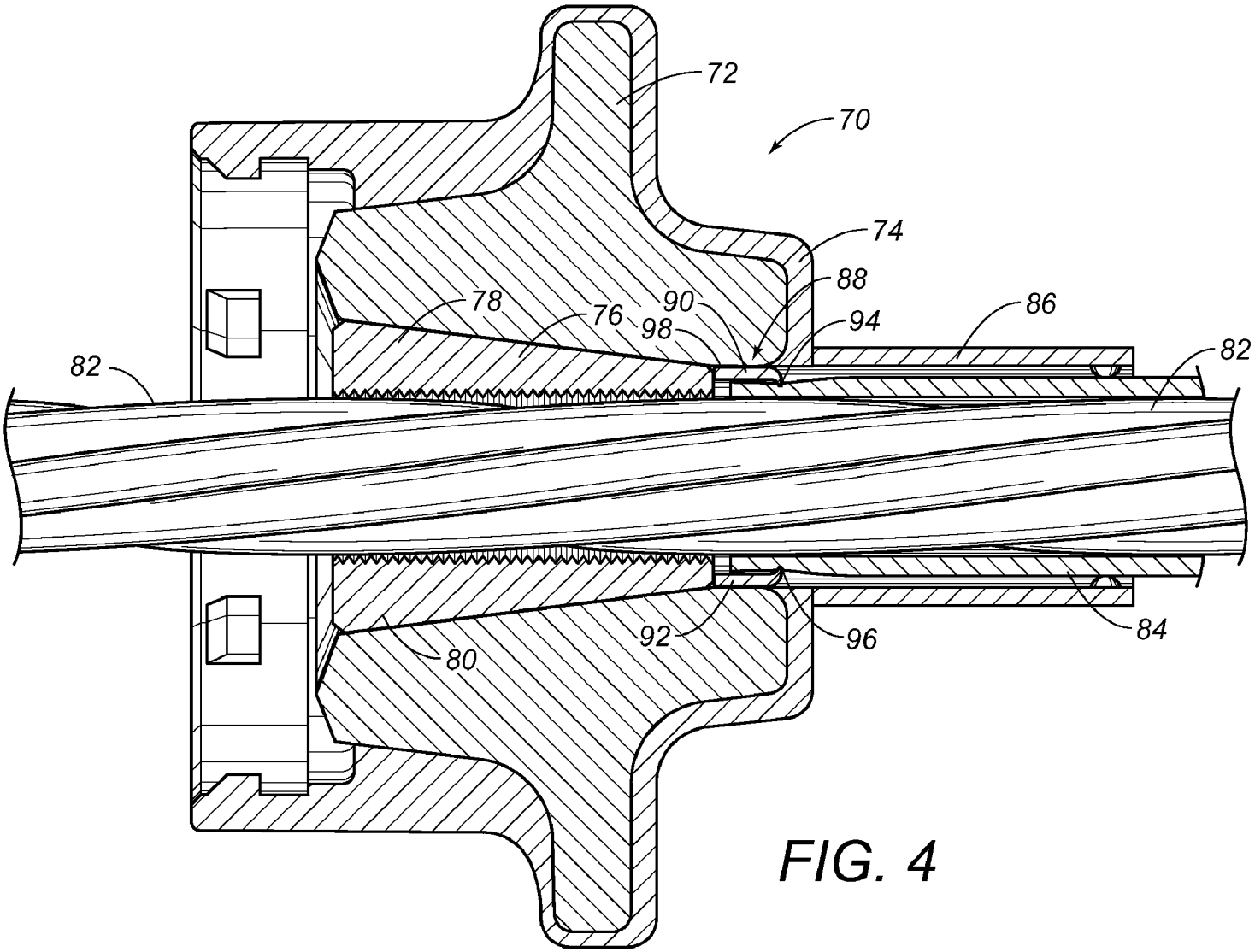
FIG. 4 is a cross-sectional view of alternative embodiment of the apparatus of the present invention.

FIG. 4 shows an alternative embodiment of the present invention. The apparatus 70 of this alternative embodiment also includes an anchor body 72 located within a polymeric encapsulation 74. The anchor body 72 includes a wedge cavity 76 of a similar configuration of the embodiment of FIG. 1. Wedges 78 and 80 are positioned within the wedge cavity 76 so as to be in strong engagement with the tendon 82 extending therethrough. Tendon 82 has sheathing 84 extending therearound. The polymeric encapsulation 74 also includes a trumpet 86 extending outwardly from an end thereof.

Unlike the previous embodiment, the fixing means 88 of the embodiment of FIG. 4 includes a pair of clip members 90 and 92. These clip members have a pointed ends 94 and 96. The clip members 90 and 92 extend between the wall of the passageway 98 and the exterior surface of the sheathing 84. When each of the clip members 90 and 92 is forced into the passageway 98, the pointed ends 94 and 96 will "bite" into the sheathing 84 so as to engage the sheathing and to prevent shrinkage of the sheathing.

Typically, when the wedges 78 and 80 are installed into the wedge cavity 76, the ends of the wedges 78 and 80 will push on the ends of the clip members 90 and 92 so as to force the pointed ends 94 and 96 into the polymeric material of the sheathing 84. Since each of the clip members 90 and 92 has a surface strongly urged against the inner wall of the passageway 98, the pointed ends 94 and 96 will be strongly retained within the material of the sheathing 84. As a result, the end of the sheathing 84 will be strongly retained within the passageway 98 of the wedge cavity 76.

Figure 5:
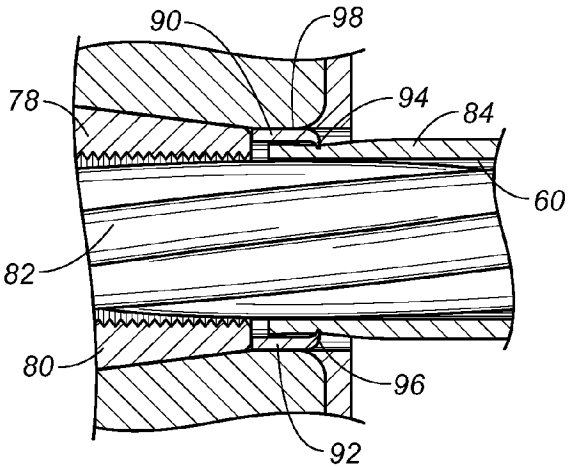
FIG. 5 is an enlarged cross-sectional view showing the relationship of the clip members and the sheathing at the end of the tendon.

FIG. 5 shows a detailed view of how the clip members 90 and 92 are urged so as to engage the sheathing 84. Wedges 78 and 80 will abut the ends of the clip members 90 and 92 and, during installation, force the clip members 90 and 92 through the passageway 98 such that the pointed ends 94 and 96 will pierce or bite into the material of the sheathing 84. The sheathing 84 will reside in surface-to-surface relationship with the underlying tendon 82. Once again, the tight urging of the clip members 90 and 92 against the inner wall of the passage 98 will further serve to prevent any liquid intrusion into the interior cavity of the anchor body 72.

Figure 6:
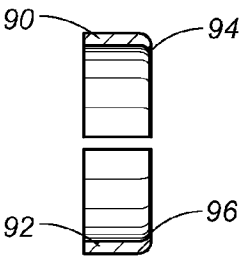
FIG. 6 is a cross-sectional view of the clip members as used in the alternative embodiment of the present invention.

FIG. 6 shows the clip members 90 and 92. Each of the clip members 90 and 92 has a generally semicircular configuration. The pointed ends 94 and 96 extend inwardly. Each of the clip members 90 and 92 will generally extend around the diameter of the tendon 82 so as to effect a sealing relationship with the sheathing 84 and to engage, in a biting manner, into the material of the sheathing 84.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An apparatus comprising:

an anchor body having a cavity formed in an interior thereof;

a tendon extending into said cavity, said tendon having a sheathing extending at least partially thereover, said tendon having a sheathed portion and an unsheathed portion, said sheathed portion extending into said cavity of said anchor body;

a pair of wedges positioned in frictional engagement with said unsheathed portion of said tendon in said cavity of said anchor body; and a pair of clip members arranged on diametrically opposite sides of said sheathing, each of said pair of clip members having a generally curved portion with a sharp end, said sharp end biting into said sheathing, said pair of clip members positioned in said cavity of said anchor body.

2. The apparatus of claim 1, said pair of clip members interposed between a wall of said cavity and said sheathing.

3. The apparatus of claim 2, said pair of clip members positioned adjacent an end of said pair of wedges within said cavity.

4. The apparatus of claim 1, said anchor body having a polymeric encapsulation extending thereover, said polymeric encapsulation defining a trumpet extending outwardly of said anchor body in axial alignment with said cavity, said sheathed portion of said tendon extending through said trumpet.

5. The apparatus of claim 1, said cavity of said anchor body having a tapered portion so as to have wide end opening at one end of said anchor body and a narrow end interior of said anchor body, said anchor body having a passageway extending from said narrow end of said cavity so as to open at an opposite end of said anchor body.

6. The apparatus of claim 5, said pair of wedges extending along said tapered portion of said cavity.

7. The apparatus of claim 6, said passageway having a generally constant diameter.

8. The apparatus of claim 4, said trumpet having a seal extending around an interior thereof so as to be in liquid-tight sealing relation with said sheathed portion of said tendon.

* * * * *